US005645129A

United States Patent [19]

Renna

[11] Patent Number: 5,645,129

[45] Date of Patent: Jul. 8, 1997

[54] FIRE EXTINGUISHER DISPENSER

[76] Inventor: Edward M. Renna, 3231 Drane Field Rd., Lakeland, Fla. 33811

[21] Appl. No.: 596,522

[22] Filed: Feb. 5, 1996

[51] Int. Cl.[6] ..... A62C 13/06

[52] U.S. Cl. ..... 169/51; 242/398

[58] Field of Search ..... 169/51; 242/397, 242/406

[56] References Cited

U.S. PATENT DOCUMENTS

| | | | |
|---|---|---|---|
| 3,145,375 | 8/1964 | Webb | 169/51 |
| 3,738,429 | 6/1973 | Heller et al. | 169/51 |
| 4,062,493 | 12/1977 | Suggs | 169/51 |
| 4,482,123 | 11/1984 | Corbeil et al. | 169/51 |

FOREIGN PATENT DOCUMENTS

| | | | |
|---|---|---|---|
| 406054922A | 3/1994 | Japan | 169/51 |

*Primary Examiner*—Gary C. Hoge

*Attorney, Agent, or Firm*—George A. Bode; Michael L. Hoelter; Bode & Associates

[57] ABSTRACT

A dispenser reel assembly for automatically dispensing a fire extinguisher upon activation. This dispenser reel assembly is typically supported from an overhead support well above the floor, thereby protecting the fire extinguisher from damage and/or theft. To operate the assembly, a release plate covering a lower opening of a supporting frame is removed, thereby permitting the cable, and hence the suspended fire extinguisher, to be dispensed from the reel assembly via gravity. Typically, the fire extinguisher will come to rest about eight (8') feet above the floor so as not to inadvertently cause injury or damage. To lower the extinguisher further, a short retrieve rope is used to pull the extinguisher downwardly so that the extinguisher can either be used or removed from the dispenser reel assembly for use and/or inspection.

20 Claims, 5 Drawing Sheets

FIRE EXTINGUISHER DISPENSER

BACKGROUND OF THE INVENTION

1. Field of the Invention

This invention pertains to fire extinguishers in general and, more particularly, to a means of strategically and conveniently storing such fire extinguishers in an out-of-the-way local while still meeting local codes and providing for their immediate accessibility should the need arise.

2. General Background

The art relating to fire extinguishers and their supporting structure is quite varied. U.S. Pat. No. 3,738,429 issued to Heller, et al., discloses a perforated hose that is coiled together well above the floor of a building or the like. A foil strip retains the coil intact; but should a fire occur, the foil strip will fail thereby allowing the hose to freely hang downward while water or some other extinguishing material is emitted from its perforations.

Japanese Patent No. 6-54922 issued to Kameoka discloses a variation of this in that a fire hydrant is installed in the ceiling with its door facing downward. Upon the opening of the door, the hose becomes immediately available to anyone located underneath.

With respect to cylindrical fire extinguishers, U.S. Pat. No. 3,067,822 issued to Hattenhauer discloses a wall cabinet for the safe storage of such cylinders.

U.S. Pat. No. 3,702,157 issued to Thomas also discloses a wall-supported cylindrical fire extinguisher. In this version, the cylinder is pivotally mounted such that it can rotate about a vertical axis. Its hose, being extra long, is coiled around the body of the cylinder such that when the need arises, the hose is simply uncoiled from around the cylinder thereby causing the cylinder to spin about its vertical axis.

U.S. Pat. No. 4,548,274 issued to Simpson discloses another wall-supported fire extinguisher cabinet that incorporates a decorative housing so that the cabinet is more aesthetically pleasing. Upon the detection of a fire, its door slides down thereby revealing the extinguisher inside.

U.S. Pat. Nos. 4,586,687 and No. 5,354,029 both issued to Ziaylek, Jr., and No. 432,545 issued to Morse demonstrate the variation in elements.

Many of these devices are attempts to conceal the fire extinguishing equipment from view or to remove such equipment from normal access. While they may each function as designed, they often require elaborate set-up and sometimes are not readily available for inspection, visual or otherwise. Also, in some cases, these devices are not suitable for outdoor installation or installations involving more extreme environments. These devices are also not generally adaptable for use in open bays or other open areas of a building or overhang.

It is thus an object of this invention to provide an inexpensive manner of storing cylindrical fire extinguishers in a great many different locals.

A further object of this invention is to provide a means of storing such extinguishers in a manner that is readily available should the need arise, but which is out-of-the-way during normal day-to-day activities.

Yet another object of this invention is to provide a fire extinguisher dispenser that conforms with the rules and regulations relating to such material.

Still another object of this invention is to provide a system that can be used outdoors as well as in other locations that may include environmental extremes.

A further object of this invention is provide a dispensing mechanism that relies upon gravity for operation, thereby being basically fail-safe.

Still another object of this invention is to provide a dispensing mechanism that can be installed anywhere in large open bays rather than being limited solely against a wall or column or the like, thereby freeing up such space for other uses while also protecting the cylinder from accidental abuse or damage. These and other objects and advantages of this invention will become obvious upon further investigation.

SUMMARY OF THE PRESENT INVENTION

The preferred embodiment of the apparatus of the present invention solves the aforementioned problems in a straightforward and simple manner. This invention pertains to a fire extinguisher dispenser assembly that incorporates a frame having a lower opening and which supports a dispenser reel assembly therein. A dispensing cable is wound around a portion of this dispenser reel assembly, with this cable having a loop connector at its depending free end which is sized to support a fire extinguisher therefrom. Covering the lower opening of the frame is a release plate that has a slot therein sized to allow the cable to pass therethrough. However, to prevent the cable from freely passing through this slot, a stop is secured to the cable which engages the upper surface of the release plate, thereby preventing the cable from further passage through the slot. To activate the invention, a release assembly is operated to release the release plate from the frame, thereby allowing the cable, and the fire extinguisher, to fall via gravity away from the dispenser reel assembly.

BRIEF DESCRIPTION OF THE DRAWING

For a further understanding of the nature and objects of the present invention, reference should be had to the following description taken in conjunction with the accompanying drawing in which like parts are given like reference numerals and, wherein:

FIG. 1 is a pictorial view, partially cut away, of the operating and dispensing mechanism of the preferred embodiment of the present invention;

DETAILED DESCRIPTION OF THE PREFERRED EMBODIMENT

Figures 2, 3:
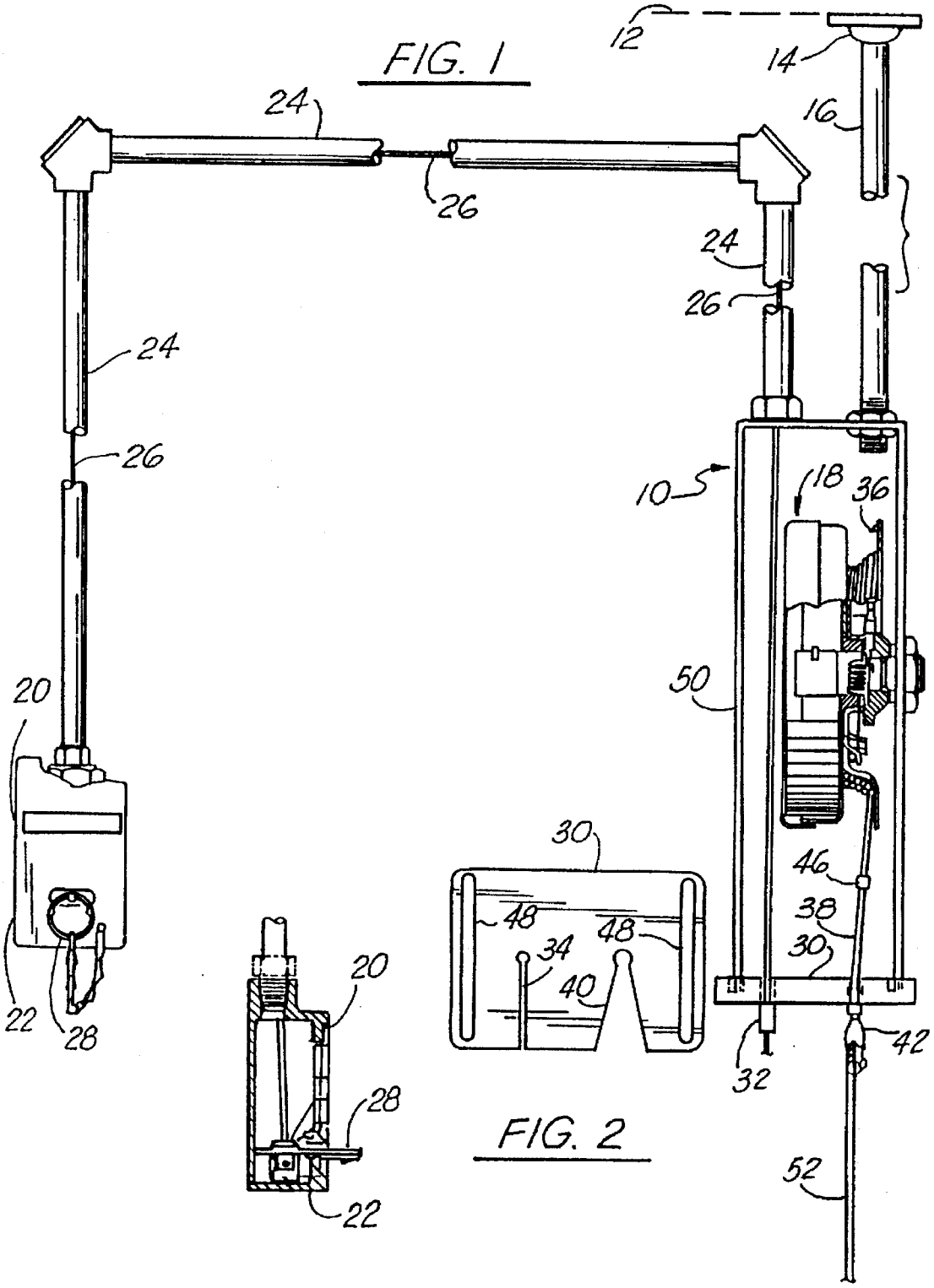
FIG. 2 is a plan view of the release plate for the embodiment disclosed in FIG. 1.
FIG. 3 is a side pictorial view, partially cut away, of the remote release station of the embodiment of FIG. 1.

Referring initially to FIGS. 1–3, there is shown the preferred embodiment of fire extinguisher dispenser 10. This dispenser 10, is designed to help bring the users thereof into compliance with NFPA 10 standards for portable fire extinguishers and with NFPA 30A standards relating to automobile and marine service stations, among others. Dispenser 10 is designed to replace the standard wall hung or wall supported fire extinguisher cabinets and/or brackets. It is also designed to overcome or resolve fire code violations that arise due to theft, vandalism, space or location problems, weather or other corrosive conditions, and other possible excuses.

As shown in FIG. 1, dispenser 10 is securely mounted to a ceiling or overhead beam or support 12 such as by bracket 14. This overhead support 12 can be horizontal as shown, or such support 12 can be pitched or inclined. Dispenser 10 can also be mounted from a column by means of a knee brace or it can be recessed in a suspended ceiling surrounded by a fire barrier. No matter what type of support 12 dispenser 10 may be secured to, whether indoors or out and whether surface mounted or recessed, dispenser 10 is generally installed so as to be vertically suspended, and hence self-leveling, from such support 12.

Also, while not disclosed in FIG. 1, dispenser 10 would also generally be clearly identified, or covered with a cloth or skirt clearly identifying this dispenser 10 as a "fire extinguisher". This housing or this dispenser 10 may also indicate the type of extinguisher it houses, i.e. ABC, $CO_2$, water, purple K, etc. Additionally, this skirt may also extend beyond the lower end of the fire extinguisher, if so desired, so as to make this extinguisher housing more visible. As will be explained in greater detail below, the fire extinguisher contained by dispenser 10 can be dispensed manually at dispenser 10 or the fire extinguisher can be dispensed mechanically or electronically from a remote location. In any event, all installations would carry operating instructions and would clearly identify the type of fire extinguisher to be dispensed. Such clear markings are needed in areas where different extinguishers are in use and/or available.

If dispenser 10 is to be operated from a remote location, as is the embodiment of FIGS. 1–3, it is preferable for such remote location to still be within sight or view of dispenser 10 (i.e. to be within 200 feet or so of dispenser 10). This is so that the fire extinguisher contained within dispenser 10 will only be deployed in a manner that will not unintentionally cause injury to another. Dispenser 10 can also be equipped with a self contained alarm system (see the description with respect to FIG. 7 hereinbelow) or dispenser 10 can be connected to any existing central or remote fire alarm system (see the description with respect to FIG. 8 hereinbelow). As can be imagined, should dispenser 10 be connected to a central or remote fire alarm system, the monitoring system can be immediately and automatically signaled or alerted to the operation of dispenser 10 so that the proper authorities and/or fire department can be contacted.

As indicated above, many options exist for use with dispenser 10. Some of these options, depending upon desires and existing operating conditions, are a self-contained alarm, central alarm hook-up, battery operated interior light, rotating or flashing light for power failures or the like, hermetically sealed housing for weather and corrosive conditions, smoke or heat detectors, and automatic dispensing operations with strobe light activation for locating the fire extinguisher in the dark or in smoke. Other options also exist or can be imagined.

Referring now more particularly to FIG. 1, a short length of pipe 16 or other strong support member (which is preferably longer than about 12 inches) is typically used to suspend dispenser reel assembly 18 from bracket 14. Additionally, when locating and installing dispenser 10, care should be taken to insure that access to the fire extinguisher is possible, i.e. access to the fire extinguisher should be readily available by both handicapped and non-handicapped personnel. Also, care should be taken to insure that the dispensed extinguisher will not be blocked by machinery, equipment, barricades, or other structure whether of a permanent or temporary nature.

In the embodiment of FIG. 1, pipe 16 is generally threaded at both ends with one end being mounted to bracket 14 which is secured to support 12 and with the other end of pipe 16 being fixed to dispenser reel assembly 18 via locking nuts or other such devices, or by welding.

Remote release station 20 (FIGS. 1 and 3) would, in turn, be secured to a wall or other support in the normal fashion such as by using mounting holes in housing 22 surrounding release station 20. As indicated earlier, it is preferable for remote release station 20 to be within about 200 feet or so of dispenser reel assembly 18 and for the two to be clearly visible from each other. Also, remote release station 20 should be mounted so that it is accessible by both handicapped and non-handicapped personnel, in other words, it should be mounted no higher that about five (5') feet above the floor.

Extending between remote release station 20 and dispenser reel assembly 18 is conduit 24 which should be installed using as few elbows or joints as possible. This conduit 24 is hollow and can be standard EMT piping if so desired. Passing through hollow conduit 24 is cable 26 which would preferably be plastic coated stainless steel and which can be 3/64 or 1/16 inch in diameter or so. One end of cable 26, as shown, would be retained in remote release station 20 via pin 28. This pin 28 would be installed in the normal fashion in station 20 so that it would limit the movement of this end of cable 26, however, pin 28 would also be designed to be readily removable from release station 20, thereby releasing cable 26, should the need arise. This manner of operation of pin 28 is of typical construction involving the normal fittings, adjustments, cover plate and stop among other items.

The opposite end of cable 26 is secured to release plate 30 which forms a lower part of reel assembly 18. This end of cable 26 contains a cable connector or stop 32 so that cable 26 can be slipped into and held within a first narrow slot 34 of release plate 3 see FIG. 2). During installation, any slack in cable 26 is removed so that there will be little if any slack in cable 26. Also, there should be pulleys and/or guides in each of the elbows and along the length of conduit 24 so that conduit 24 will not interfere with or hinder the operation and/or release of cable 26 when the need arises. Steps must be taken to insure that cable 26 will not be snagged of become 'hung-up' within conduit 24, instead, cable 26 must be allowed to freely travel within conduit 24 when the need arises.

Prior to final insertion of cable 26 within narrow slot 34, dispenser reel assembly 18 is pre-wound to the required tension. This is normally accomplished by rotating dispenser reel 36 to either tighten or loosen a spring (not shown), such as a coil spring, within assembly 18. After being wound or unwound to the proper tension, dispenser cable 38 is slowly fed from reel 36 so that cable loop connector 42, secured to the end of dispenser cable 38, can be slipped through second large slot 40 of release plate 30 (see FIG. 2). Since it is desirable for there to be some slight tension in dispenser cable 38, cable loop connector 42 (being larger than the opening of second slot 40) will retain release plate 30 in place. However, if after such assembly it is determined that either more or less tension is required, dispenser reel 36 can be either further tensioned or some of its pre-wound tension can be released. In some cases, a special tool may be required for this adjustment step.

After dispenser cable 38 is properly installed within second slot 40, cable 26, extending between remote release station 20 and dispenser reel assembly 18, is installed within first slot 34 as indicated above. This is accomplished by simply crimping a cable connector 32 to the end of cable 26 that extends through first slot 34. Any slack in cable 26 can be taken up at either end thereof, i.e. by pulling on the end of cable 26 that extends through release plate 30 before crimping connector 32 thereon or by taking up such cable slack within release station housing 22 in the normal fashion before inserting pin 28. This latter method of eliminating slack may involve adjustments with a set screw prior to the installation of pin 28.

Once pin 28, cable 26 and dispenser cable 38 are properly installed and tensioned, a fire extinguisher 44 (see FIG. 6) can be hung from cable loop connector 42 by using any typical quick release connector such as a carabiner or the like. Of course, the weight of fire extinguisher 44 upon cable 38 will cause cable 38 to become unwound from reel 36. Such unwinding is easily prohibited by first inserting cable stop 46 on cable 38 a short distance from loop connector 42 and slightly above release plate 30. This stop prevents cable 38 from further passage through second slot 40 in release plate 30. Thus, release plate 30 is now subject to downward forces resulting from the weight of fire extinguisher 44. However, such downward forces are now resisted by cable 26 and connector 32 such that release plate 30 remains in place.

To further align release plate 30 with respect to dispenser reel assembly 18, a pair of oppositely spaced notches 48 are cut or made in release plate 30 which correspond to the ends of U-shaped frame 50 (see FIG. 2). These notches 48 along with the tension in cable 26 help retain release plate 30 in place against the downward force of fire extinguisher 44.

Also suspended from cable loop connector 42 is one or more retrieve ropes 52, each having a pull handle 54 at its lower depending end. In the embodiment of FIGS. 1–3, there would generally only be one retrieve rope which would extend just beyond the end of fire extinguisher 44. By this arrangement, after fire extinguisher 44 is released from dispenser 10 and allowed to fall downward a predetermined distance in a controlled manner, this retrieve rope 52 would then be pulled so as to allow fire extinguisher 44 to be further lowered and then released from connector 42 via the quick release carabiner.

Prior to actual operation, however, the length of dispenser cable 38 is adjusted so that upon release of fire extinguisher 44 from dispenser 10, extinguisher 44 is only capable of falling to within about eight (8') feet or so of the floor. This is to insure that such release and falling of fire extinguisher 44 will not inadvertently cause injury or harm. Thus, once fire extinguisher 44 is suspended this distance above the floor, the need for retrieve rope 52 becomes apparent so that fire extinguisher 44 may be manually pulled to a lower elevation for eventual removal from loop connector 42 and subsequent use. If need be, the actual length of retrieve rope 52 may be adjusted as needed so that its pull handle 54 will be at an elevation that can easily be reached by both handicapped and non-handicapped individuals.

Thus, to activate the preferred embodiment illustrated in FIGS. 1–3, pin 28 would be pulled from remote release station 20, thereby releasing cable 26 which will, in turn, frees release plate 30 from the bottom of U-shaped frame 50. Upon such release, the weight of fire extinguisher 44 will unwind dispenser cable 38 from dispenser reel 36, thereby allowing fire extinguisher 44 to fall, in a controlled manner, its predetermined distance. Upon reaching this elevation, generally eight (8') feet above the floor, pull handle 54 is grasped to further manually lower extinguisher 44 for subsequent use and/or removal. From this operation, it can thus be seen the importance that cable 26 not be hindered or snagged within conduit 24 so that release plate 30 can be freed from frame 50 in order to enable extinguisher 44 to move downwardly. Also, as extinguisher 44 moves further away from dispenser reel 18, its enclosed spring becomes further tensioned which aids in controlling the fall of extinguisher 44.

Figure 6:
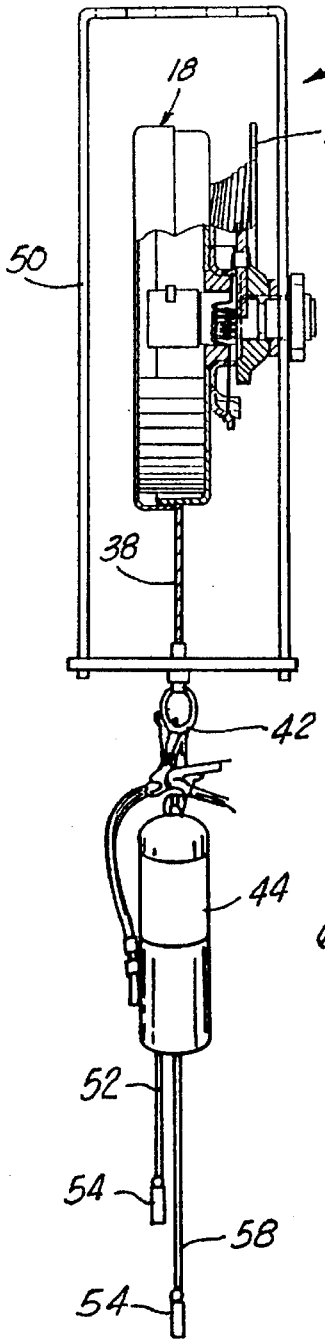
FIG. 6 is a pictorial view, partially cut away, of the embodiment of FIG. 4 with the fire extinguisher attached thereto.
Figure 5:
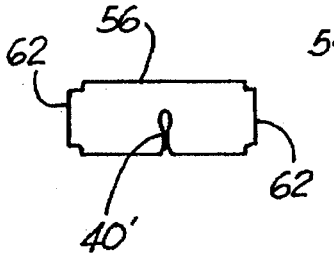
FIG. 5 is a plan view of the release plate for the embodiment disclosed in FIG. 4.
Figure 4:
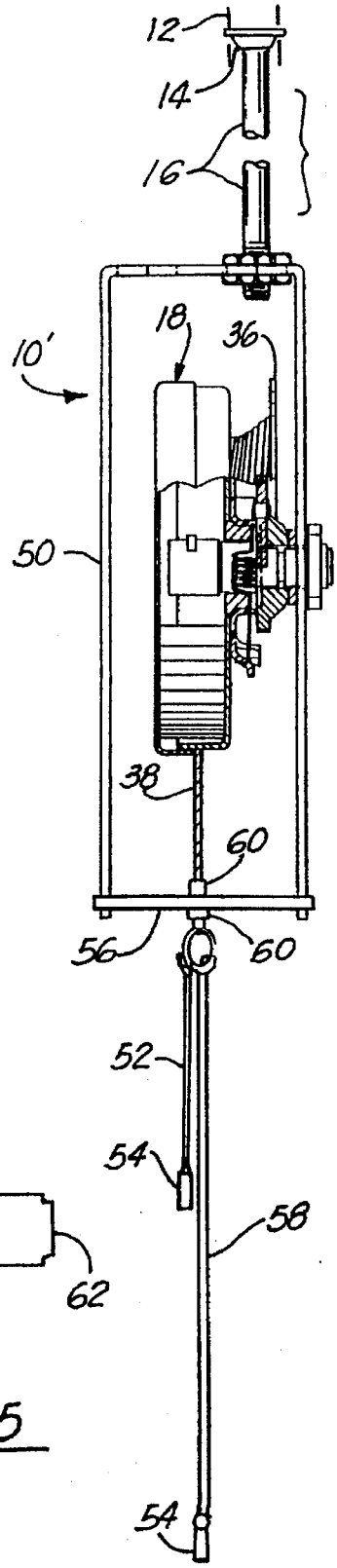
FIG. 4 is a pictorial view, partially cut away, of the operating and dispensing mechanism of an alternate embodiment of the present invention.

Referring now to FIGS. 4–6, there is shown an alternate embodiment of fire extinguisher dispenser 10', but one which is not operated from a remote location. Instead, this embodiment discloses how dispenser 10 would be operated at the site of dispenser 10. In this alternate embodiment, dispenser reel assembly 18 would be mounted as previously described via bracket 14 and would operate in much the same manner. However, in this situation, a different release plate 56 would be employed and an additional longer retrieve rope 58 would be utilized.

In this local activation embodiment, release plate 56 (FIG. 5) is configured with only a single slot 40' therein which accommodates dispenser cable 38. This dispenser cable 38 is held in place with respect to release plate 56 via cable connectors 60 which are crimped or otherwise secured to cable 38 on opposite sides of release plate 56 as shown. According to this assembly, cable 38 will not be slack but instead will be tensioned due to the weight of fire extinguisher 44 which results in some corresponding tension on release plate 56. Also, release plate 56 is configured with extending tabs or keys 62 that extend into mating openings (not shown) in the end of U-shaped frame 50. By this configuration, cable stop 46 is not required since the attachment of release plate 56 to frame 50 (via tabs or keys 62) and the securement of cable 38 to release plate 56 via cable connectors 60 will, together, prevent the downward fall of the now balanced hung fire extinguisher 44.

Another difference of this alternate embodiment of FIGS. 4–6 from that disclosed in the preferred embodiment of FIGS. 1–3 is the incorporation of additional retrieve rope 58. This rope 58 is secured to cable loop connector 42 in a like manner, but it extends much further down from dispenser 10. In fact, it extends to a position that is reachable from the floor. By this arrangement, when fire extinguisher dispenser 10 is in need of operation, longer retrieve rope 58 is initially pulled so as to release fire extinguisher 44, thereby allowing it to fall downwardly. Once extinguisher 44 is at its lowest position, the second, shorter retrieve rope 52 is pulled so as to allow fire extinguisher 44 to be further grasped and lowered for eventual release from connector 42 via the quick release carabiner.

Also, in this alternate embodiment of FIGS. 4–6, when fire extinguisher 44 is initially hung from release plate 56, the weight of extinguisher 44 may pull plate 56 out from frame 50. If this occurs, additional tension must be applied to dispenser cable 38 by pre-winding such cable 38 so as to further tension the spring within dispenser reel 36. Such additional tension must be made until fire extinguisher 44 can be suspended or balanced from release plate 56 without causing plate 56 to become released from frame 50.

By this embodiment, when retrieve rope 58 is pulled, the top cable connector 60 causes release plate 56 to deflect downwardly, thereby causing tabs 62 of release plate 56 to come loose from the mating openings in U-shaped frame 50. This then frees fire extinguisher 44 to move downwardly, in a controlled manner, under gravity, until it comes to rest some eight (8') feet or so above the floor. As indicated above, the spring contained in dispenser reel assembly 18 would control and stop the continued downward fall of extinguisher 44. At this time, the user would simply grasp short retrieve rope 52 to pull extinguisher 44 further downwardly (against the tension of the spring in dispenser reel assembly 18) for eventual removal from loop connector 42.

Figure 7:
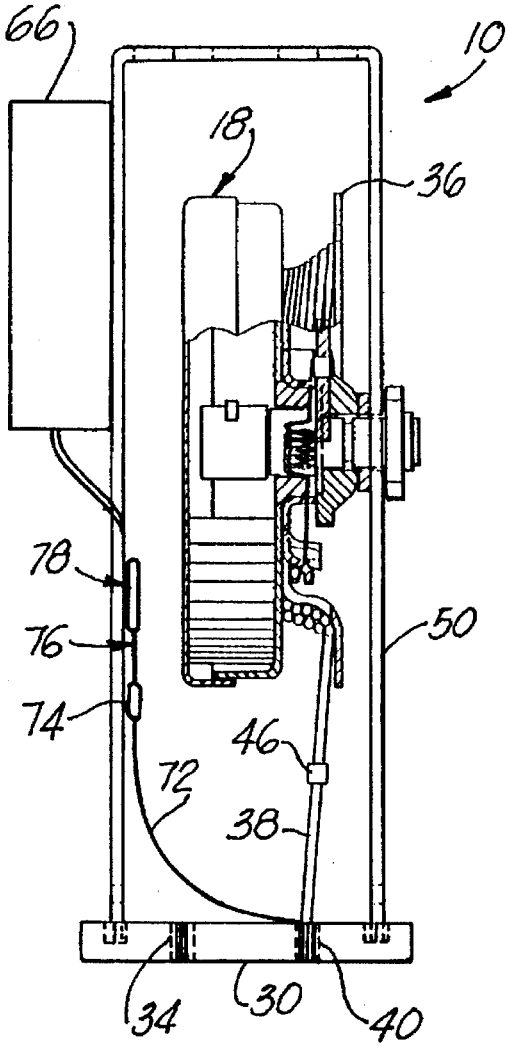
FIG. 7 is a pictorial view, partially cut away, of the preferred method of connecting the invention to a self-contained alarm system.
Figure 8:
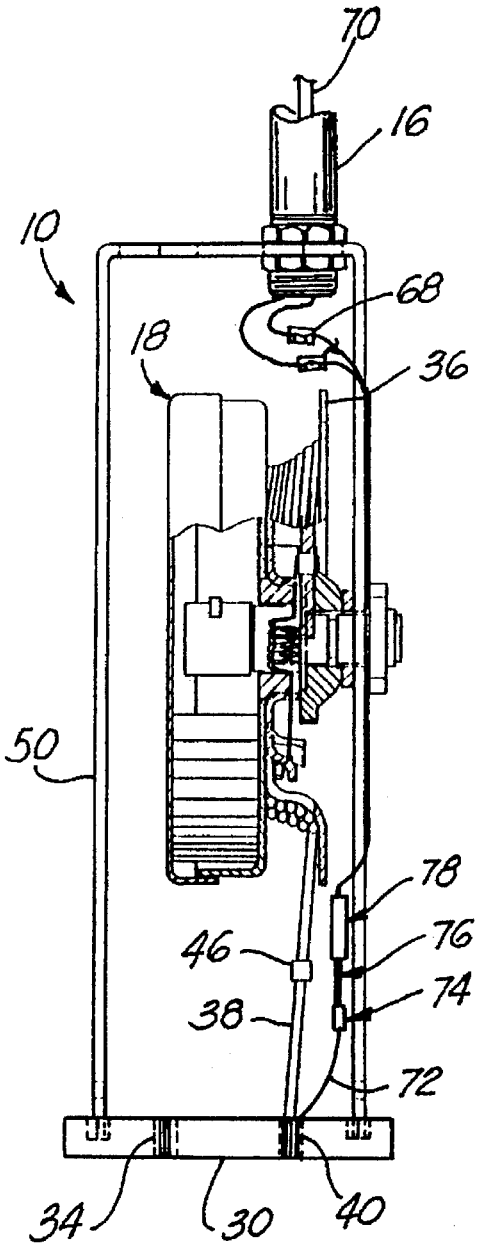
FIG. 8 is a pictorial view, partially cut away, of the preferred method of connecting the invention to a remote or central alarm system.

Referring now to FIGS. 7 and 8, different versions of securing dispenser 10 (or dispenser 10') to fire alarms are shown. Of course, other versions may also be employed, these versions only being offered to illustrated the securement of dispenser 10 to a self contained alarm system (FIG. 7) and to a remote, central alarm system (FIG. 8). In either system, an alarm would automatically be activated upon the release of fire extinguisher 44 from dispenser 10.

According to the self contained alarm system of FIG. 7, a battery operated, self contained alarm assembly 66 would be secured to the exterior of U-shaped frame 50 as shown. This alarm assembly 66, which may contain both a light and an audible alarm, would contain the appropriate hardware, including monitors, switches and the like, that would become activated upon the release of fire extinguisher 44. Ideally, the battery or power source for such assembly 66 would be changed or checked on an regular basis, and preferably whenever scheduled maintenance on dispenser 10 is done.

According to the remote alarm system of FIG. 8, electrical connections 68 are made to wires 70 from a remote, central alarm system (not shown). This system too would have the proper and necessary hardware for proper operation and it may also incorporate a local light and audible alarm signal.

In either system, however, an actuator line 72, actuator cap 74, switch arms 76 and alarm switch 78 would be employed so that the release of release plate 30 (or 56 in the alternate embodiment 10') can be monitored. Generally, one end of actuator line 72 is secured to dispenser cable 38 in the vicinity of release plates 30 or 56 while the other end is secured to actuator cap 74. By this configuration, should cable 38 become unwound from reel 36, actuator line 72 will cause cap 74 to activate switch 78 so that either alarm assembly 66 will become activated or remote alarm system 70 will be alerted that fire extinguisher 44 has been released. Remote system 70 can also be configured so that the local fire department can be automatically alerted to this event as well.

Figure 9:
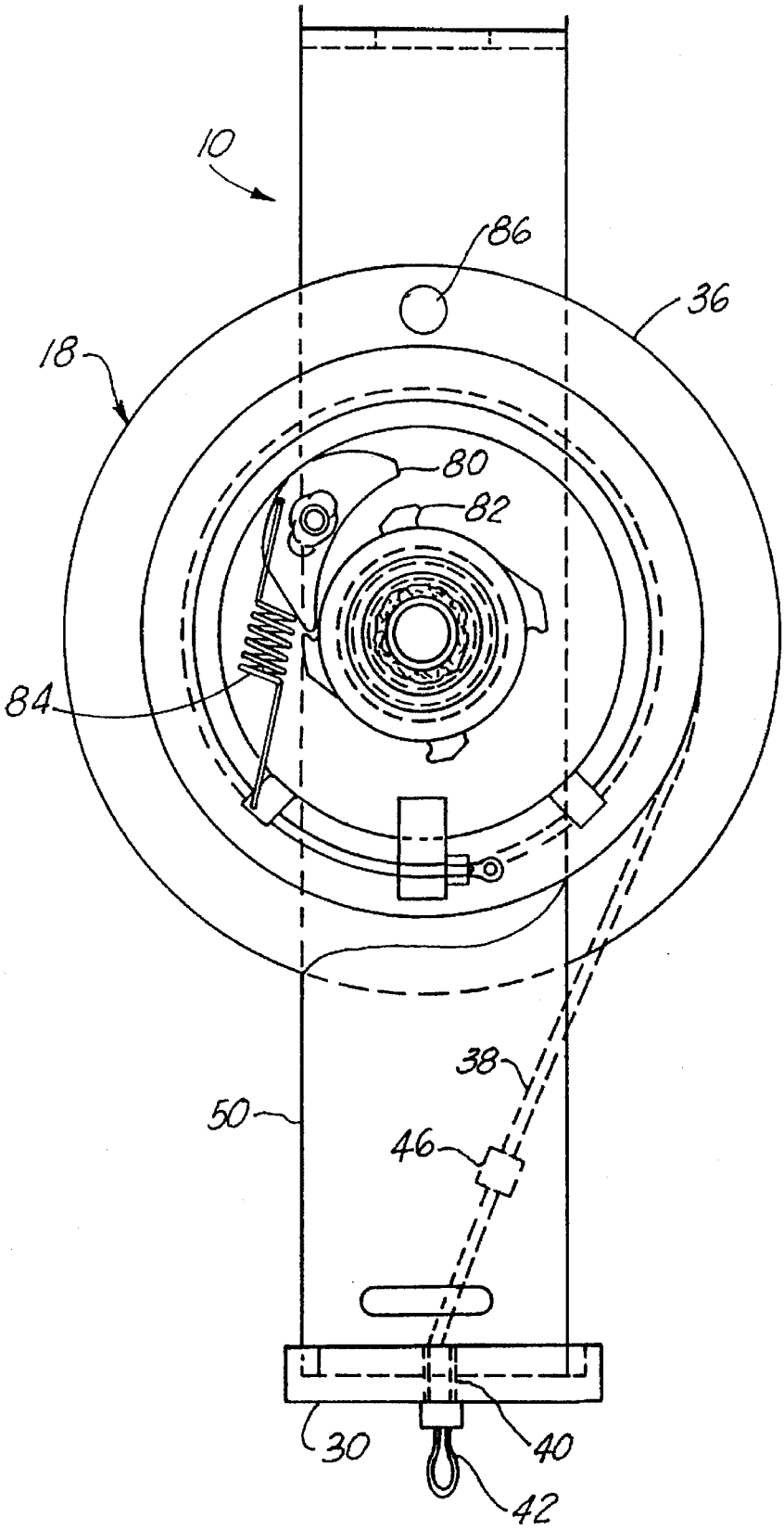
FIG. 9 is an enlarged side pictorial view, partially cut away, of the dispensing mechanism of the preferred embodiment of the present invention; and, FIG. 10 is an enlarged pictorial view, partially cut away, of the dispensing mechanism of the preferred embodiment of the invention.
Figure 10:
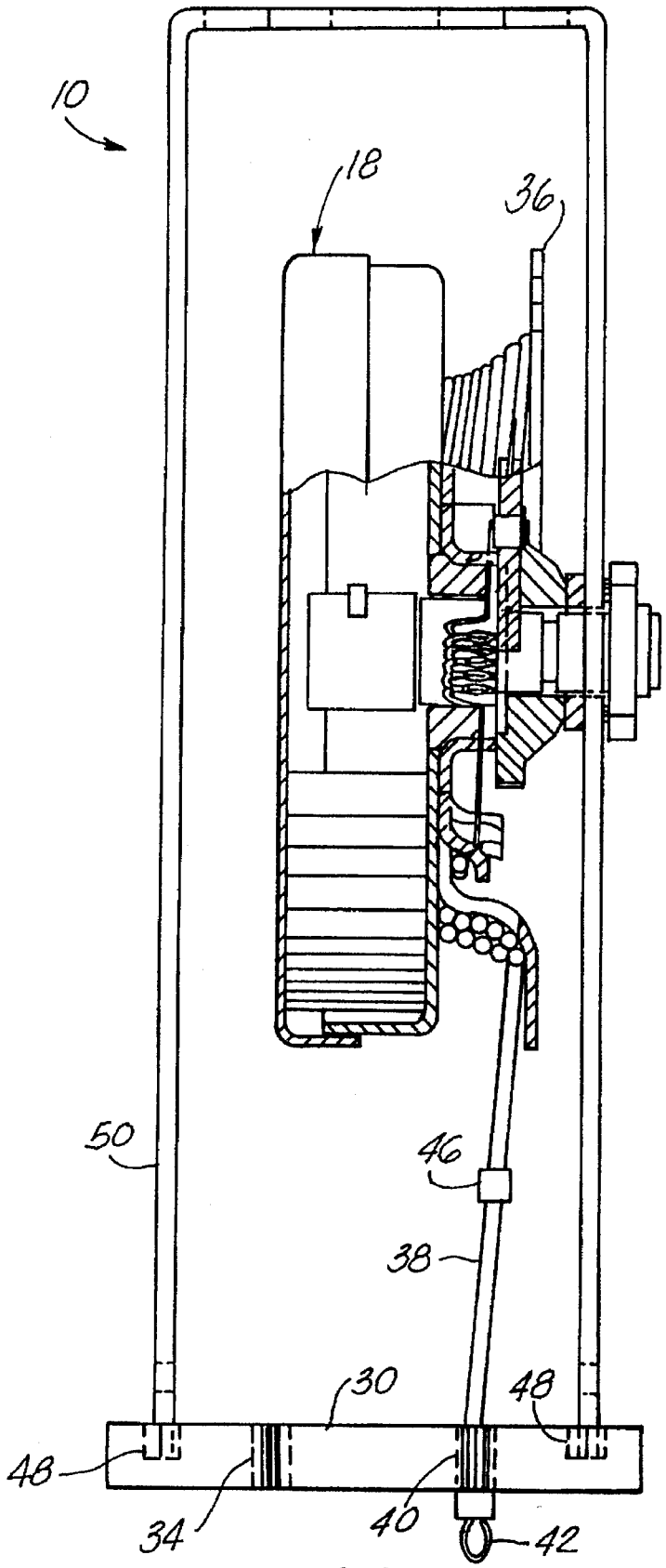

Referring now to FIGS. 9 and 10, there is shown typical dispenser reel assembly 18 in greater detail. However, it should be understood that a great many different types of such dispensing mechanisms can be used in fire extinguisher dispensers 10 and 10'. The typical dispenser reel assembly 18 disclosed in FIGS. 9 and 10 is, as indicated, a spring loaded, ratchet type assembly that enables cable 38 to be reeled out and locked into position. By dislodging ratchet arm 80 from rachet 82 (such as by overcoming the tension of spring 84), reel 36 can be re-wound, thereby restoring assembly 18 back to its original wound position. During normal operation, rachet arm 80 and rachet 82 prevent the enclosed spring 84 from inadvertently causing cable 38 to become re-wound around reel 36. Instead, as cable 38 is unwound from reel 36, this ratcheting assembly effectively locks reel 36 in place, thereby preventing cable 38 from being re-wound.

However, if the tension in the enclosed spring is in need of being released, this can be accomplished by simply inserting a tool within tool release hole 86 or by some other equally simple manner depending on the dispenser reel assembly 18 employed. Such a procedure can also be used to restore dispenser reel assembly 18 back to its original wound position. Additionally, reel assembly 18 can be re-wound mechanically by securing a motor (not shown) to such assembly 18.

Also, as indicated, dispenser reel assembly 18 is supported or housed within U-shaped frame 50 in the typical manner as shown, such as by a threaded fastener or the like. Frame 50 may be of many different configurations which may range from an open U-shape design to a more enclosing box shape. Also, frame 50, while disclosed herein as being top supported, may also be side or bottom supported, depending on the configuration of support 12. However, the important feature of frame 50 is its open lower end which is to accommodate release plate 30 (or 56).

A further option is to employ a means of activating dispenser 10 electrically. This operation would involve a low voltage battery back-up and would be capable of electrically releasing cable 38 in a typical manner, such as by the use of solenoids and the like. Such a manner of electrically releasing cable 38 can be utilized at gasoline stations and/or other similar areas where a multitude of dispensers 10 can be installed within sight of the store clerk.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A fire extinguisher dispenser assembly comprising:

(a) a frame having a lower opening therein;

(b) a dispenser reel assembly mounted within said frame;

(c) a dispensing cable wound around a portion of said dispenser reel assembly, said dispensing cable having a loop connector at its depending free end with said loop connector being configured to support a fire extinguisher therefrom;

(d) a release plate covering said lower opening of said frame, said release plate having a slot therein sized to allow said dispensing cable to pass therethrough;

(e) means secured to said dispensing cable and spaced from said loop connector for preventing the further passage of said dispensing cable through said slot, and;

(f) means for releasing said plate from said frame, thereby allowing said dispensing cable, and said fire extinguisher, to be dispensed downwardly away from said dispenser reel assembly.

2. The dispenser assembly as set forth in claim 1, wherein said dispenser reel assembly is a spring loaded ratchet type assembly which controls the winding and unwinding of said dispensing cable.

3. The dispenser assembly as set forth in claim 1, wherein said dispensing cable comprises a plastic coated stainless steel cable.

4. The dispenser assembly as set forth in claim 1, wherein said frame is U-shaped.

5. The dispenser assembly as set forth in claim 1, wherein said frame is supported from an overhead support.

6. The dispenser assembly as set forth in claim 1, further comprising a first elongated retrieve means having a first end secured to said loop connector, said first retrieve means being suspended downwardly a predetermined distance below said fire extinguisher with the depending opposite end of said first retrieve means having a handle secured thereto.

7. The dispenser assembly as set forth in claim 6, further comprising a second retrieve means secured to and depending from said loop connector with the free end of said second retrieve means extending beyond said handle of said first retrieve means.

8. The dispenser assembly as set forth in claim 1, wherein said means for releasing includes a remote release station.

9. The dispenser assembly as set forth in claim 8, further comprising a second cable extending through a conduit intermediate said remote release station and said frame.

10. The dispenser assembly as set forth in claim 9, wherein a first end of said second cable comprises a stop that abuts a second slot in said release plate and wherein the opposite second end of said second cable is retained in place within said remote release station via a removable pin.

11. A fire extinguisher dispenser assembly comprising:

(a) a frame having an open bottom;

(b) a dispenser reel assembly mounted within said frame;

(c) a dispensing cable wound around a portion of said dispenser reel assembly, said dispensing cable having a loop connector at its depending free end, said loop connector being configured to support a fire extinguisher therefrom, and said reel assembly controlling the winding and unwinding of said cable;

(d) a release plate covering said open bottom of said frame, said release plate having a slot therein sized to allow said dispensing cable to pass therethrough;

(e) means secured to said dispensing cable and spaced from said loop connector, said means being sized for preventing the further passage of said dispensing cable through said slot, (f) means for releasing said plate from said frame, thereby allowing said dispensing cable, and said fire extinguisher, to be dispensed downwardly via gravity away from said dispenser reel assembly; and, (g) an elongated retrieve rope having a first end secured to said loop connector, said retrieve rope being suspended downwardly a predetermined distance below said fire extinguisher with the depending opposite end of said retrieve rope having a handle secured thereto.

12. A method of dispensing a fire extinguisher comprising the steps of:

(a) supporting a frame having a lower opening from an overhead support;

(b) mounting a dispenser reel assembly within said frame;

(c) winding a dispensing cable around a portion of said dispenser reel assembly and securing a loop connector to the depending free end of said dispensing cable, said loop connector being constructed and arranged to support a fire extinguisher therefrom;

(d) temporarily securing a release plate across said lower opening of said frame, said release plate having a first slot therein sized to allow said dispensing cable to pass therethrough;

(e) securing a stop to said dispensing cable a short distance from said loop connector, said stop being constructed and arranged to prevent the further passage of said dispensing cable through said first slot, and;

(f) securing to said release plate means for releasing said release plate from said frame, thereby allowing said dispensing cable, and hence the fire extinguisher, to be dispensed downwardly via gravity away from said dispenser reel assembly.

13. The method as set forth in claim 12, further comprising the step of constructing and arranging said dispenser reel assembly as a spring loaded ratchet type assembly to control the winding and unwinding of said dispensing cable.

14. The method as set forth in claim 13, further comprising the step of coating or enclosing said dispensing cable in plastic.

15. The method as set forth in claim 13, further comprising the step of constructing and arranging said frame as U-shaped.

16. The method as set forth in claim 15, further comprising the step of suspending a first retrieve rope downwardly from said loop connector a fixed distance below the fire extinguisher and securing a handle to the depending free end of said first retrieve rope.

17. The method as set forth in claim 16, further comprising the step of suspending a second retrieve rope from said loop connector, said second retrieve rope extending beyond said handle of said first retrieve rope.

18. The method as set forth in claim 16, further comprising the step of constructing and arranging said release means as a remote release station.

19. The method as set forth in claim 18, further comprising the step of extending a second cable through a conduit intermediate said remote release station and said frame.

20. The method as set forth in claim 19, further comprising the step of securing a stop to a first end of said second cable which abuts a second slot in said release plate and wherein the opposite second end of said second cable is retained in place within said remote release station via a removable pin.

* * * * *